US005448848A

United States Patent [19]

Moller

[11] Patent Number: 5,448,848

[45] Date of Patent: Sep. 12, 1995

[54] SHOTGUN HAVING LIGHT WEIGHT INTERCHANGEABLE BARREL TUBES

[75] Inventor: Clifford Moller, Houston, Tex.

[73] Assignee: Briley Manufacturing Co., Houston, Tex.

[21] Appl. No.: 122,020

[22] Filed: Sep. 15, 1993

[51] Int. Cl.[6] ..... F41A 21/10

[52] U.S. Cl. ..... 42/77; 89/14.05

[58] Field of Search ..... 42/76.01, 76.02, 77, 42/75.02, 75.04; 89/14.05, 16

[56] References Cited

U.S. PATENT DOCUMENTS

| | | | |
|---|---|---|---|
| 1,217,347 | 2/1917 | Rosengarten | 42/77 |
| 2,736,119 | 2/1956 | Clarkson et al. | 42/76.02 |
| 2,981,155 | 4/1961 | Parlanti | 89/16 |
| 3,339,304 | 9/1969 | Knode, Jr. et al. | 42/77 |
| 4,641,450 | 2/1987 | Moll et al. | 42/76.02 |
| 4,685,236 | 8/1987 | May | 42/76.02 |
| 4,989,359 | 2/1991 | Kinkner et al. | 42/77 |

FOREIGN PATENT DOCUMENTS

| | | | |
|---|---|---|---|
| 3805384 | 6/1989 | Germany | 42/77 |

*Primary Examiner*—Stephen M. Johnson
*Attorney, Agent, or Firm*—Pravel, Hewitt, Kimball & Krieger

[57] ABSTRACT

A shotgun barrel tube which has an enlarged chamber portion and an elongated barrel. A series of threads or grooves are formed circumferentially around the outer surface of the barrel tube to remove sufficient material to lighten the weight of the barrel tube and maintain sufficient strength to withstand internal pressure when a shotgun shell is discharged.

7 Claims, 1 Drawing Sheet

SHOTGUN HAVING LIGHT WEIGHT INTERCHANGEABLE BARREL TUBES

BACKGROUND OF THE INVENTION

This invention relates to the field of shotguns and, more particularly, shotguns with interchangeable barrel tubes of varying gauge sizes.

Shotguns are designed to fire one or more relatively small pellets called shot through a barrel with a smooth bore. Shotguns can either have a single barrel, or can be double barreled with the two barrels placed either side-by-side or one over the other (over-and-under).

Shotgun bore sizes commonly range from 12 gauge, 16 gauge, 20 gauge, 28 gauge and 0.410 bore. Barrels can be formed with different choke patterns due to the size made in the outer or muzzle end of the barrel to control the pattern of shot as it leaves the shotgun barrel. Shotgun gauges and choke patterns are selected based on the type of shooting to be done.

Because many shooters like to compete in different competition classes, shotguns have been provided with interchangeable barrels of different gauges. Interchangeable choke tubes have also been developed to be placed in the outer end of the shotgun barrel so that the shot pattern can be changed depending on shooting conditions.

Because of the expense of additional barrels, attempts have been made to develop shotguns which have interchangeable barrel tubes that fit in a 12 gauge barrel. However, since such tubes add weight to a shotgun, which can either tire a shooter or throw off his or her aim, a carrier barrel has been developed to be used with a 12 gauge barrel so that interchangeable tubes can be used to change gauges instead of having a complete barrel for each gauge. One such attempt is shown and described in U.S. Pat. No. 4,989,359 where an over-and-under shotgun is provided with a 12 gauge barrel and a second carrier barrel which is capable of accommodating internal barrel tubes of various gauges that can be utilized with 16 gauge, 20 gauge, 28 gauge and 0.410 bore shells. In this way, only two barrels are necessary for a full range of shotgun gauges. A similar development is shown and described in U.S. Pat. No. 5,018,293.

These barrel tubes are formed in two separate sections, an enlarged diameter chamber section in which a shell is initially placed and an elongated barrel section through which shot travels after the shell is discharged. The chamber section is formed of a relatively high strength material such as stainless steel or a titanium alloy and the barrel portion, being subjected to lower forces than the chamber, is formed of a light weight metal such as an aluminum alloy.

The barrel tubes have inner bores which are compatible with the gauge to be shot and outer diameters with separate ferrels or support portions that engage the inner diameter of the carrier barrel.

Previously designed barrel tubes are relatively heavy, weighing from 14–19 ounces. Because of the number of targets shot during a competition, the weight of such tubes adds to shooter fatigue over a long period of time and makes use in a 12 gauge barrel undesirable, thus giving rise to the development of the relatively expensive carrier barrel described above.

Since these barrel tubes are relatively thin, it has been considered difficult to reduce their weight and still maintain the structural integrity of the tube when subjected to competition shooting. Therefore, it would be advantageous to provide lighter weight barrel tubes which are interchangeable within the barrel of a 12 gauge shotgun to eliminate the need for a carrier barrel and allow such tubes to be used with ease in a 12 gauge barrel.

SUMMARY OF THE INVENTION

In order to solve the problems discussed above, an improved shotgun barrel tube has been provided which is sized and shaped to fit within a cylindrical barrel support. The barrel tube has an enlarged diameter chamber portion for receiving a shotgun shell and an elongated barrel portion with a cylindrical internal bore. The chamber and elongated barrel have outer diameter portions at each end of the barrel tube and at least one along the length of the elongated barrel portion, which engage the barrel support for holding the barrel in place.

The weight of the barrel is reduced to its minimum level by forming a series of substantially circumferential threads or grooves around the outer surface of both the chamber and the elongated barrel portion along substantially their entire length. The threads or grooves remove sufficient material to lighten the weight of the barrel but maintain sufficient wall thickness to withstand internal pressures when the shotgun shell is discharged.

Preferably, the barrel is helically relieved or threaded in order to maintain maximum strength characteristics after removal of the material. However, circumferential grooves are acceptable provided they are formed relatively close to each other and are uniform so as not to create any weak sections along the length of the barrel.

The chamber and elongated barrel portions are formed as separate components with cooperating threads for joining them. The chamber is formed of a relatively strong material such as a titanium alloy or stainless steel in order to withstand the forces imparted by the discharge of the shotgun shell.

The strength characteristics of the elongated barrel portion are not as rigorous and it can be formed of an aluminum alloy which is much lighter weight without any recess cracking because shotguns operate at relatively low pressures and have an exponential pressure drop moving away from the chamber.

The threads or grooves are formed along substantially the entire length of the elongated barrel at a uniform diameter and pitch. The outer edge of the ridges which form the threads or grooves are preferably flattened along most of the elongated barrel, with one or more portions, depending on the gauge, being maintained to engage the inner surface of the barrel support. An unthreaded or ungrooved portion is preferably formed at both ends and outer of the elongated barrel and at the outer end of the chamber in order to provide support.

BRIEF DESCRIPTION OF THE DRAWINGS

A better understanding of the invention can be obtained by referring to the description of an exemplary embodiment set forth below when considered in conjunction with the drawings, in which.

DETAILED DESCRIPTION OF AN EXEMPLARY EMBODIMENT

Figure 1:
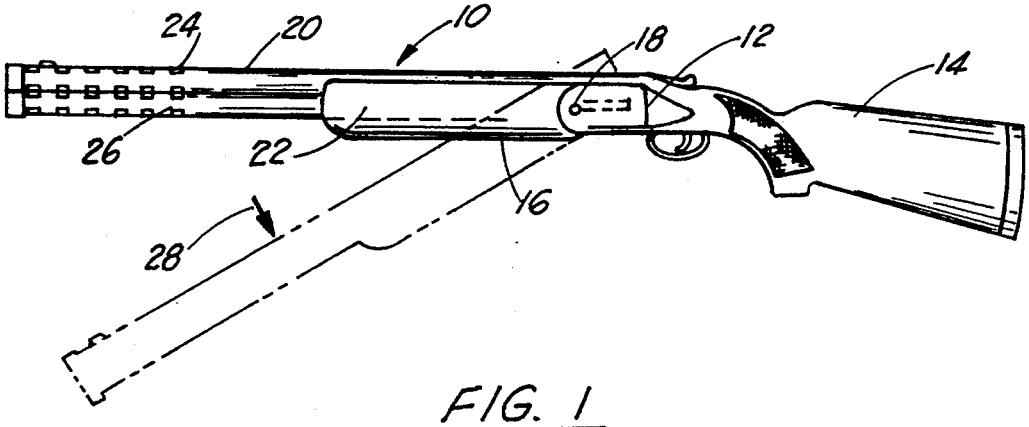
FIG. 1 is a side perspective view of an over-and-under shotgun of the type in which the present invention can be used, with the broken lines showing the gun breach opened.

FIG. 1 shows an over-and-under, two-bore shotgun 10 which is typical of the type of gun in which the present invention can be used. The shotgun 10 includes a receiver 12, a shoulder stock 14 connected to the rear of the receiver 12, a foreend iron 16 which is connected through a pivot pin 18 to the front of the receiver 12. A barrel 20 is mounted on the iron 16 through a wooden hand grip 22 that is rigidly mounted on the iron.

The barrel 20 has upper and lower bores 24 and 26 shown in their shooting position in FIG. 1. The broken lines in FIG. 1 show the barrel 20 in its retracted position after it has moved in the direction of arrow 28 so shells can be loaded into the breech. Ejector-extractor operating mechanisms are provided in the bores in order to automatically eject the spent shell casings when the breech is opened. These ejector-extractors will not be described in detail since they are well known in the art.

Figure 2:
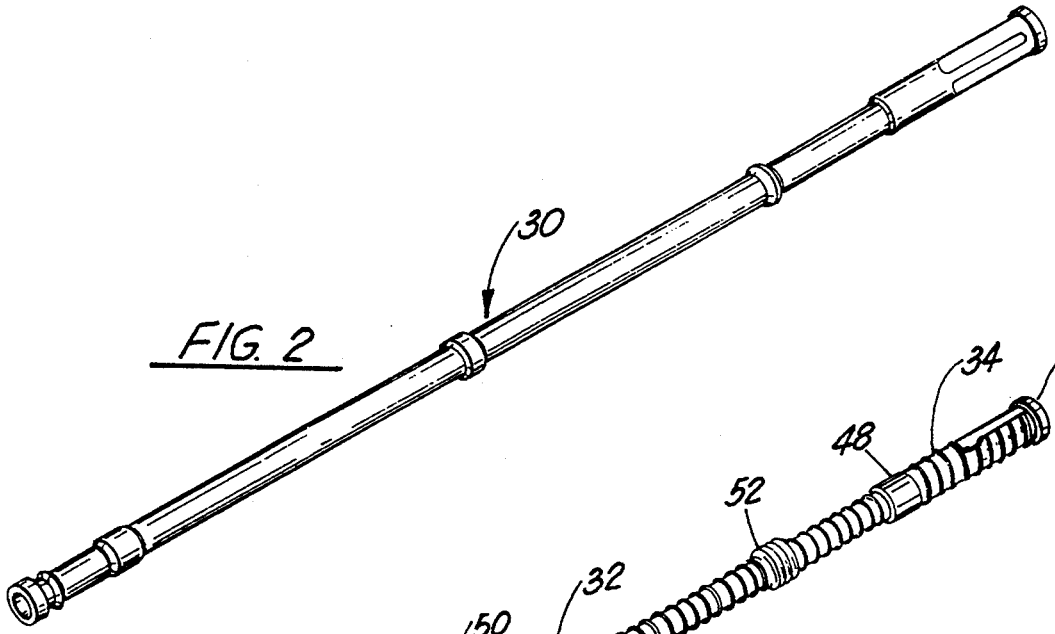
FIG. 2 is a perspective view of a prior art barrel tube.

The present invention is directed to barrel tubes that can be used in the barrel 20 of a standard 12 gauge shotgun, which are light enough in weight as not to significantly affect the weight of the gun when the barrel tube is inserted. For example, existing barrel tubes 30 as shown in FIG. 2 currently weigh from 14–19 ounces. When such tubes are used in a standard 12 gauge shotgun, tubes that heavy are believed to affect the ability of the shooter over a relatively long period of time because of shooter fatigue. The invention is directed to forming such barrel tubes which can be used in standard shotgun barrels, preferably 12 gauge, but make them significantly lighter in weight and still have the capability of withstanding the internal forces caused by discharging shotgun shells. It has been found that by utilizing the present invention, a tube set can be created with each barrel tube weighing less than 11 ounces in a full length of a standard 12 gauge shotgun. Such tubes could also be used in carrier barrels.

Figure 3:
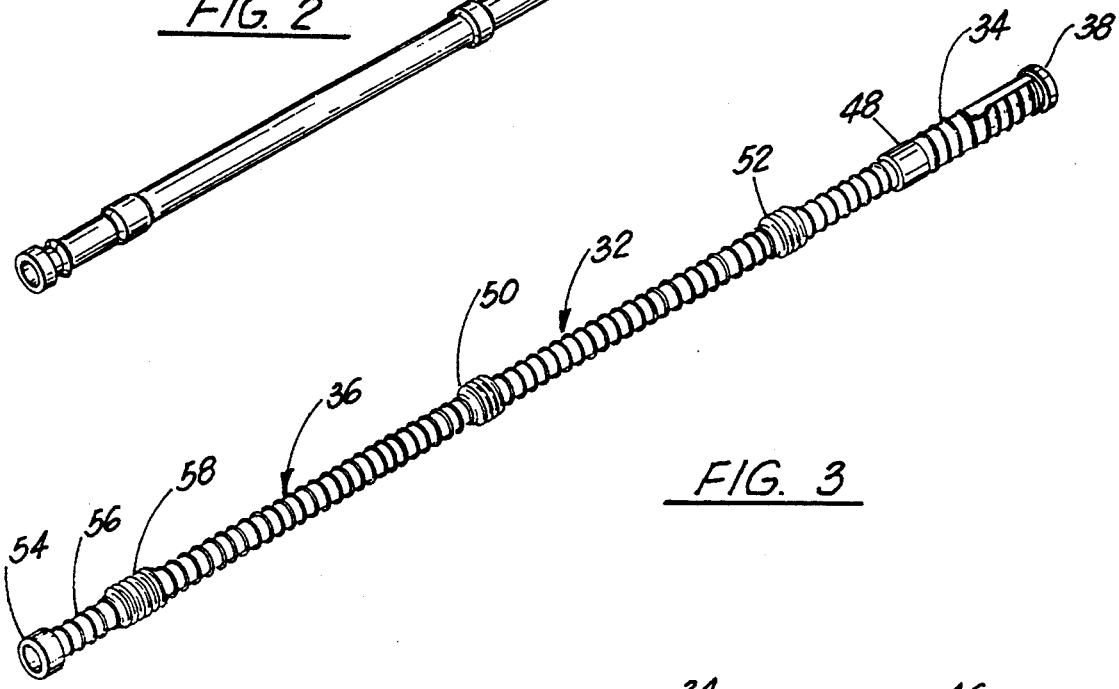
FIG. 3 is a perspective view of a barrel tube improved by utilizing the present invention.
Figure 4:
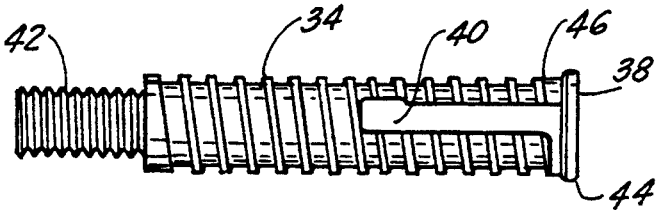
FIG. 4 is a side plan view of the chamber portion of the improved tube of FIG. 3.

The improved barrel tube 32 is shown in FIG. 3, which is formed with a chamber portion 34 and an elongated barrel portion 36. The design shown in FIG. 3 is one which has been adapted for a 28 gauge shell for use in a barrel bore of 12 gauge size. The chamber is formed as a separate component from the elongated barrel portion 36, and is shown in FIG. 4. The chamber portion is designed to receive in its outer end 38 a shotgun shell, and includes moveable component 40 which slides along the chamber 34 and is operated by the shell injectors/extractors on the gun, as is well known in the art.

The chamber is formed of a relatively strong material such as a titanium alloy or stainless steel and is threaded on its end 42 to mate with cooperating threads on the inner portion of the elongated barrel portion 36 (not shown) so that they can be connected as shown in FIG. 3. The chamber portion is made lighter in weight by providing a series of circumferential grooves or threads on its outer surface which remove sufficient material to lighten the weight of the chamber but maintain sufficient thickness to withstand internal pressures when a shotgun is discharged.

The chamber, as shown, has threads that are flattened on their outer surface and designed to engage the inner bore of the barrel 20 along substantially the entire length of the chamber. Enough material, however, has been removed to substantially lighten the weight of the chamber. Although a helical thread design is preferable because it maintains the maximum strength characteristics of the chamber, the chamber could also have circumferential grooves in its outer surface to lighten its weight without losing strength. The threads or grooves must be substantially circumferential and substantially concentric around the chamber, however, in order to maintain the strength characteristic.

The barrel tube shown in FIG. 3 is an embodiment of a 28 gauge tube. Starting at the end 38, a ridge 44 is larger than the inner bore of the barrel 20 and holds the tube in place in the barrel 20. A solid portion 46 is provided adjacent to the ridge 44 and is slightly smaller than and engages the inner surface of the barrel 20. The remainder of the chamber 34 is threaded as shown in particular in FIG. 4, with flattened helical threads and either curved or flat grooves between the raised portions. For this chamber, the outer diameter of the threads is slightly smaller than the bore of the barrel 20 to maintain a tight fit within the bore. For this embodiment of the invention, this portion of the chamber is approximately 3¼" long, with about a ¾" threaded portion 42 to mate with the internal threads on the barrel tube 32. The threads on the threaded portion 42 can be any type of fine thread which will tightly engage the two components.

It has been found that for a 20 gauge chamber, the chamber wall thickness, non-threaded, should be 0.055"–0.10". The pitch of the threads, in terms of the distance from one thread to the other, should range from 0.04" to 0.09". The width of the grooves, whether they be curved or flat between adjacent raised portions should range from 0.02" to 0.100". The outer diameter of the grooves or flats between the raised portions should range from 0.725" to 0.850".

For a 28 gauge chamber, the dimensions should be 0.085"–0.150" (non-threaded chamber wall thickness); 0.04"–0.20" (thread pitch); 0.02"–0.10" (tool nose radius or flat); and 0.640"–0.80" (root or groove diameter).

For a 0.410 chamber, the optimum dimensions are 0.125"–0.150" (non-threaded chamber wall thickness); 0.04"–0.20" (thread pitch); 0.02"–0.100" (tool nose radius or flat); and 0.510"–0.80" (root or groove diameter).

Referring to the elongated barrel portion 32 as shown in FIG. 3, a non-threaded outer portion 48 is formed adjacent to the chamber 34, in which internal threads are formed (not shown) to accommodate the threads 42 on the chamber 34. The section 48 is about 1" long with an outer diameter that is slightly smaller than the bore of the barrel 20.

A ferrel or centering support 50 is formed approximately at the center of the elongated barrel 32, which is slightly smaller in diameter than the bore of the barrel 20 for supporting the barrel 32. The portion of the tube between the solid portion 48 and centering support 50 is threaded or grooved, with one or more sections 52 that are slightly smaller in diameter than the bore of the barrel 20 to provide additional support within the bore of the barrel 20. The threads in the remaining portion are flat threads which have had the sharp ends machined off, the portion 52 having the threads without the ends machined off.

The muzzle end 54 of the elongated tube 32 also has an unthreaded portion for providing support within the bore of the barrel 20. The inner surface of the tube at the end 54 is also internally threaded in order to accommodate a choke tube of the type known in the art. The length of the barrel portion 32 in which the internal threads are formed, designated by reference numeral 56, is either unthreaded or ungrooved or only slightly threaded or grooved so that additional material is provided to accommodate the internal threads. The tube has another portion 58 with outer diameter unflattened threads which also are slightly smaller than the inside diameter of the bore of the barrel 20 to provide additional support within the bore. The remainder of the length of the barrel portion 32 has flattened threads as described above. In the embodiment shown in FIG. 3, the portions 54 and 56 in which the internal threads for the choke tube, together are about 1¼" long, the raised portion 58 is about ½", the portion with the flattened threads extending to the centering support 50 is about 13", the centering support 50 being about ¼" wide. The portion between the centering support and the raised threads 52 is about 4½", the raised threads 52 about ½", and the distance between them and the solid portion 48 about 5½".

For the 28 gauge barrel portion 32, it has been found that a non-threaded barrel wall thickness should range from 0.04"–0.90", the thread pitch should range from 0.04"–0.09", the tool nose radius or flat between the threads should range from 0.02"–0.10" and the outer diameter of the thread or groove roots should range from 0.570"–0.670".

It should be understood that variations in this configuration can be made for 20 gauge and 0.410 barrels, but that the principles of grooving and providing support remain the same.

For a 20 gauge barrel portion, the following ranges are preferable: 0.025"–0.09" (barrel wall thickness); 0.04"–0.09" (thread pitch range); 0.02"–0.10" (tool nose radius or flat); and 0.635"–0.725" (root or groove diameter). For a 0.410 diameter barrel, the following ranges are preferable: 0.055"–0.10" (barrel wall thickness); 0.04"–0.20" (thread pitch); 0.02"–0.10" (tool nose radius or flat); and 0.43"–0.56" (root or groove diameter).

By providing the design described above, a lighter weight barrel tube can be used with 12 gauge shotguns which eliminates the need for a carrier barrel. The tubes are designed to withstand the pressure generated by discharge of shotgun shells, but by having circumferential grooves or threads formed in their outer surface enough material has been eliminated to lighten their weight significantly. In order to maintain the proper strength characteristics of the barrel tubes, the grooves or threads must be formed circumferentially around the tubes and have a relatively short pitch as described above. By providing the improved barrel tubes, shooters will have the versatility of four shotguns in one by being able to convert their 12 gauge shotguns to ones that can also shoot 20 gauge, 28 gauge and 0.410 shells.

It should be understood that the invention described herein is claimed below to cover its fullest scope and that all improvements or modifications made hereto are intended to be covered within the scope of the claims as set forth below.

What is claimed is:

1. An improved shotgun barrel tube having an outer surface sized and shaped to fit within a cylindrical barrel support, the barrel tube including an enlarged diameter chamber portion for receiving a shotgun shell and an elongated barrel portion with a cylindrical internal bore, the chamber portion and elongated barrel portion having outer diameter portions at each end of the barrel tube and at least one place along the length of the elongated portion which engage the barrel support, the improvement comprising:

a series of threads or grooves formed substantially circumferentially around the outer surface of the barrel tube along substantially its entire length, whereby the threads or grooves remove sufficient material from the barrel tube to lighten its weight but maintain sufficient thickness to withstand internal forces when said shotgun shell is discharged.

2. The improved shotgun barrel tube of claim 1, wherein the chamber and elongated barrel portions are formed as separate components with cooperating threads for joining them.

3. The improved shotgun barrel tube of claim 2, wherein the chamber portion is formed of a titanium alloy.

4. The improved shotgun barrel tube of claim 2, wherein the chamber portion is formed of stainless steel.

5. The improved shotgun barrel tube of claim 2, wherein the elongated barrel portion is formed of an aluminum alloy.

6. The improved shotgun barrel tube of claim 1, and further including support portions at both ends of the barrel tube and at least generally in the center of the elongated barrel portion for engaging the inner surface of the cylindrical barrel support, the remaining portions of the barrel tube having a diameter that is lesser than the support portions.

7. The improved shotgun barrel tube of claim 1, wherein the series of threads or grooves comprise helical threads.

* * * * *